US011674715B2

(12) United States Patent
Kim

(10) Patent No.: US 11,674,715 B2
(45) Date of Patent: Jun. 13, 2023

(54) DUCT EXPOSING RESERVOIR OF DRAIN PUMP

(71) Applicants: SUNGSHIN HASCO LIMITED, Gyeongsan-si (KR); Yong Tae Kim, Seongnam-si (KR)

(72) Inventor: Yong Tae Kim, Seongnam-si (KR)

(73) Assignees: SUNGSHIN HASCO LIMITED, Gyeongsan-si (KR); Yong Tae Kim, Seongnam-si (KR)

( * ) Notice: Subject to any disclaimer, the term of this patent is extended or adjusted under 35 U.S.C. 154(b) by 239 days.

(21) Appl. No.: 16/874,549

(22) Filed: May 14, 2020

(65) Prior Publication Data

US 2020/0271352 A1 Aug. 27, 2020

Related U.S. Application Data

(63) Continuation of application No. PCT/KR2019/015157, filed on Nov. 8, 2019.

(30) Foreign Application Priority Data

Dec. 24, 2018 (KR) ..... 10-2018-0168735
Sep. 9, 2019 (KR) ..... 10-2019-0111479

(51) Int. Cl.
*F24F 13/22* (2006.01)
*F24F 7/06* (2006.01)
*F24F 1/0057* (2019.01)

(52) U.S. Cl.
CPC ..... *F24F 13/222* (2013.01); *F24F 7/06* (2013.01); *F24F 1/0057* (2019.02)

(58) Field of Classification Search
CPC ..... F24F 13/224; F24F 13/222; F24F 13/22; F24F 2013/227; F24F 1/0057; F24H 8/006
See application file for complete search history.

(56) References Cited

U.S. PATENT DOCUMENTS 3,758,236 A 9/1973 Zimmerman
6,322,326 B1 * 11/2001 Davis ..... F04D 29/628 417/279

(Continued)

FOREIGN PATENT DOCUMENTS

EP 1318361 6/2003
EP 1318361 A1 * 6/2003 ..... F24F 13/20

(Continued)

*Primary Examiner* — Christopher R Zerphey
(74) *Attorney, Agent, or Firm* — Korus Patent, LLC; Seong Il Jeong

(57) ABSTRACT

Provided is a duct which is installed adjacent to a wall-type air conditioner to pass through a pipe connected to the air conditioner, which includes a base housing installed on a wall surface adjacent to the air conditioner, a horizontal partition wall disposed at the front side of the base housing to divide the inside of the duct into an upper space and a lower space, an upper housing covering the upper space, a translucent reservoir detachably mounted on a lower portion of the horizontal partition wall in response to the lower space and collecting condensed water generated from the air conditioner through an inlet formed in the horizontal partition wall, and a pump module installed in the upper space to discharge the condensed water collected in the reservoir. The reservoir is positioned below the upper housing and the horizontal partition wall to be always exposed to the outside.

4 Claims, 13 Drawing Sheets

(56) References Cited

U.S. PATENT DOCUMENTS

| | | | | |
|---|---|---|---|---|
| 6,817,194 | B1 * | 11/2004 | Leach | F24F 13/222 62/150 |
| 8,651,824 | B2 * | 2/2014 | Ward | F24F 13/22 417/36 |
| 10,557,639 | B2 * | 2/2020 | Ahn | F24F 3/1405 |
| 2007/0028640 | A1 * | 2/2007 | Hampton | F28F 17/005 62/280 |

FOREIGN PATENT DOCUMENTS

| | | | | |
|---|---|---|---|---|
| EP | 1510765 | | 3/2005 | |
| JP | 2007309558 | | 11/2007 | |
| JP | 2017155943 | * | 9/2017 | F24F 13/22 |
| KR | 200131287 | | 1/1999 | |
| KR | 20040021337 | * | 3/2004 | F24F 1/0057 |
| KR | 200419474 | | 6/2006 | |
| KR | 100909071 | * | 7/2009 | F24F 13/22 |
| KR | 101217605 | | 1/2013 | |
| KR | 20150115564 | * | 10/2015 | F24F 13/22 |
| KR | 20160134210 | * | 11/2016 | F24F 13/222 |

* cited by examiner

DUCT EXPOSING RESERVOIR OF DRAIN PUMP

TECHNICAL FIELD

The present invention relates to a duct exposing a reservoir of a drain pump, and more particularly, to a duct which is disposed adjacent to an air conditioner, has a drain pump embedded therein and a reservoir exposed to the outside.

BACKGROUND ART

While an air conditioner operates, moisture in the atmosphere may be condensed and discharged to the outside. In general, condensed water flows down by gravity to be discharged to the outside, but when the air conditioner is located in a building, the condensed water needs to be forcibly discharged by using a drain pump.

To this end, the drain pump is disposed adjacent to the air conditioner, and the drain pump may intermittently discharge the condensed water stored in a reservoir through a pipe or a hose.

European Patent Registration No. 1318361 relates to a pump embedded in a duct, which includes an improvement in embedding an integrated pump assembly in which a reservoir and a pump are integrated in an L-shaped duct. However, in the European patent, since all the pump assemblies are embedded, an operation state and the like cannot be checked, and since the pump and the reservoir are integrally assembled, there are disadvantages that the duct needs to be separated in order to know the operation state and a capacity of the reservoir and the like may not be increased due to the embedding and the like. In addition, the aesthetic appreciation cannot be given designwise in that all the pump assemblies are embedded and only the duct is exposed to the outside.

European Patent Registration No. 1510765 discloses a pump embedded in a duct, but the aforementioned problems are not solved. In particular, although the L-shaped duct is used, as the position of the duct is changed from side to side, the L-shaped duct also needs to change a base housing and a cover housing, and even if the L-shaped duct is used as one, there is a problem that the base is exposed to the outside according to a direction.

DISCLOSURE

Technical Problem

An object of the present invention is to provide a duct with a drain pump in which a part of a pump is exposed to the outside to check an operation state, a capacity of a reservoir may be changed by replacing the reservoir, and the duct needs not to be separated by replacing the reservoir and the like.

Another object of the present invention is to provide a duct with a drain pump in which a part of a pump is exposed to provide a design aesthetics, and one duct may be applied to both left and right types irrespective of the left and right types.

Yet another object of the present invention is to provide a duct with a drain pump in which a reservoir is not located in a duct but exposed to the outside and the reservoir is separated from the duct without separating the duct to be easily cleaned and replaced.

Technical Solution

In order to achieve the objects of the present invention, according to an exemplary embodiment of the present invention, there is provided a duct which is installed adjacent to a wall-type air conditioner to pass through a pipe connected to the air conditioner, which includes a base housing installed on a wall surface adjacent to the air conditioner, a horizontal partition wall disposed at the front side of the base housing to divide the inside of the duct into an upper space and a lower space, an upper housing covering the upper space, a translucent reservoir detachably mounted on a lower portion of the horizontal partition wall in response to the lower space and collecting condensed water generated from the air conditioner through an inlet formed in the horizontal partition wall, and a pump module installed in the upper space to discharge the condensed water collected in the reservoir, wherein the reservoir may be positioned below the upper housing and the horizontal partition wall to be always exposed to the outside.

The reservoir is exposed outside the duct to allow the user to easily access the reservoir. A general drain pump for an air conditioner is installed inside the duct, and thus, it is difficult to determine a position and an operation state of the pump. In addition, once the pump is installed inside the duct, it is difficult to check the state of the reservoir, and thus, even if the reservoir is left in an unsanitary state for a long time, there is no method to check the state of the reservoir.

However, in the exemplary embodiment, as the duct in which the pump is coupled to the inside and the reservoir is coupled to the outside, the installation of the duct and the pump may be completed in one installation, a position and an operation of the pump may be easily determined even in the outside, the reservoir in which condensed water is collected separately from the pump may also be relatively easily separated to separate and clean the reservoir at a desired time.

In the general drain pump for the air conditioner, since the operation of the pump may be checked only by a sound, it is not possible to check whether the pump works properly, but in the duct according to the present embodiment, the reservoir is exposed to the outside and the exposed reservoir may be partially or entirely made of a transparent, colored clear or frosted material so that the water level of the reservoir and the operation state of the pump may be visually confirmed.

In particular, in the duct according to the present invention, since the reservoir is made of a different material from other parts, it is possible to avoid a product having a conventional monotonous design, and to apply a variety of stylish and new designs.

Further, since the reservoir may be externally mounted and the capacity thereof is not limited by the housing forming the duct, there is no design difficulty in expanding the capacity of the reservoir.

Particularly, the reservoir may include hook coupling holes formed in one side or both sides of the reservoir, and elastic hooks corresponding to the hook coupling holes may be formed on at least one of the horizontal partition wall, the upper housing, and the base housing. The elastic hook passes through the hook coupling hole to be fastened to the hook coupling hole, thereby firmly fixing the reservoir to the lower portion of the horizontal partition wall.

Further, a user or a manager may release coupling to the hook coupling hole by pushing the elastic hook and easily separate the reservoir from the horizontal partition wall.

As an example, the elastic hooks may be formed on both sides of the horizontal partition wall in a reversely U-shaped shape, and the hook coupling holes may be formed in both sides of the reservoir and the elastic hooks may pass through the hook coupling holes and then be opened outwards or separated to the left and right sides to support the lower portions of the hook coupling holes.

The reservoir may be made of a translucent material such as transparency or translucency. In this case, a light emitting device may be installed adjacent to the reservoir and the light of the light emitting device may be transmitted, refracted, diffused, or scattered by the reservoir or water in the reservoir. Such a feature is used to display the operation state of the pump module and assist to externally check the level of the water stored in the reservoir.

As the light emitting device, an LED and the like may be used and as an example, when the LED is mounted on a front side of the base housing in the lower space, the light from the LED may be visualized from the front side through the reservoir. An operation state of the pump module, presence or absence of a failure, a cleaning time of the reservoir, a water level state, and the like may be displayed by using one or two or more LEDs.

Besides, the light emitting device may be mounted on the upper space and the light from the LED may be visualized to the outside through a light-transmitting hole formed in the upper housing.

The duct of the exemplary embodiment is used for installing and covering a refrigerant pipe, a power cable, a drain hose, etc., which are connected from the outside on the wall surface, and may be installed at a position for connecting the air conditioner or another connection duct. In general, the duct of the exemplary embodiment may be installed adjacent to the side surface of the air conditioner and the reservoir may collect the condensed water generated in the air conditioner and then, when a predetermined time or a predetermined water level is satisfied, the pump module may discharge the condensed water collected in the reservoir to the outside.

Accordingly, the duct of the exemplary embodiment may include an upper opening for accommodating another connection duct and a side opening for fluid communication with the adjacent air conditioner.

Although the upper opening and the side opening may be formed in advance, an installer may install the upper opening and the side opening to be adjacent to the air conditioner in the process of installing the air conditioner and form the upper opening and the side opening in the upper housing or the base housing. To this end, a cutting line may be formed in at least one of the upper housing and the base housing for the upper opening or the side opening and the installer may form the upper opening or the side opening by removing a separator sheet defined by the cutting line.

The side openings may be installed on both sides of the upper housing and the base housing, and the installer may form the side openings by removing the separator sheet or partially the sidewall in a desired direction in consideration of the positions of the air conditioner and the duct regardless of the left and right sides.

Unlike the L-shaped duct mentioned in the related art, in the duct of the exemplary embodiment, the base housing and the upper housing may be provided symmetrically, and may correspond to the arrangement of various air conditioners without preparing left and right types separately or switching the front and rear sides.

Further, a first inlet and a second inlet may be disposed toward left and right sides as inlets on both sides of the horizontal partition walls, so that adjacent inlets may be used according to the left and right types.

A protective partition wall may be formed at a center to accommodate the pump module in the upper portion of the horizontal partition wall and the upper space, and even if the pipe or the drain pipe is introduced in either of the left and right directions, the pump module may be installed in predetermined position and space without invading the installation space from the pipe and the like.

In the case of using a solenoid type pump module, the pump module may be mounted at a position separated from the horizontal partition wall, and may be mounted in a longitudinal direction in the duct through which the pipe of the drain pipe passes.

Like the exemplary embodiment, in the duct in which the pump module and the duct are integrally formed, when the duct is installed on the right side of the air conditioner, the pipe and the drain pipe may pass toward the right side of the duct, wherein the pump module may be mounted on the left side of the duct to efficiently utilize the internal space.

On the contrary, when the duct is installed on the left side of the air conditioner, the pipes and the drain pipe may pass toward the left side of the duct, wherein the pump module is mounted on the right side of the duct to efficiently utilize the internal space.

To this end, the base housing may provide an installation position of each pump to the left and right sides to fix the pump module. In addition, the base housing may also further include a hose fixing plate which is positioned on an upper portion of the horizontal partition wall and provides a central slit to fix an intermediate inlet connecting the reservoir and the pump module.

The upper housing and the base housing may be vertically elongated to be formed in a straight line and provide upper openings which are opened upward to be connected with the connection duct.

Advantageous Effects

The present invention relates to a duct installed with a pump, in which the reservoir is exposed to the outside of the duct so that a user and a manager easily access the reservoir.

In a general drain pump for an air conditioner, since a reservoir is closed or installed inside the duct, it is difficult to determine a position and an operation state of the pump. In addition, once the pump is installed, it is difficult to check the state of the reservoir, and thus even if the reservoir is left in an unsanitary state for a long time, there is no method to check the state of the reservoir.

However, in the duct of the present invention, it is possible to complete the installation of the duct and the pump in one installation, to easily determine a position of the pump even in the outside, and to separate and clean the reservoir at a user's desired time by relatively easily separating the reservoir.

In addition, in the duct according to the present invention, since the reservoir is exposed to the outside and the exposed reservoir is formed to be partially transparent or frosted, it is possible to visually check a water level of the reservoir and an operating state of the pump.

In particular, in the duct according to the present invention, since the reservoir is made of a different material from other parts, it is possible to avoid a product having a conventional monotonous design, and to apply a variety of stylish and new designs.

Further, since the reservoir may be externally mounted and the capacity thereof is not limited by the housing forming the duct, there is no design difficulty in expanding the capacity of the reservoir.

MODES OF THE INVENTION

Figure 1:
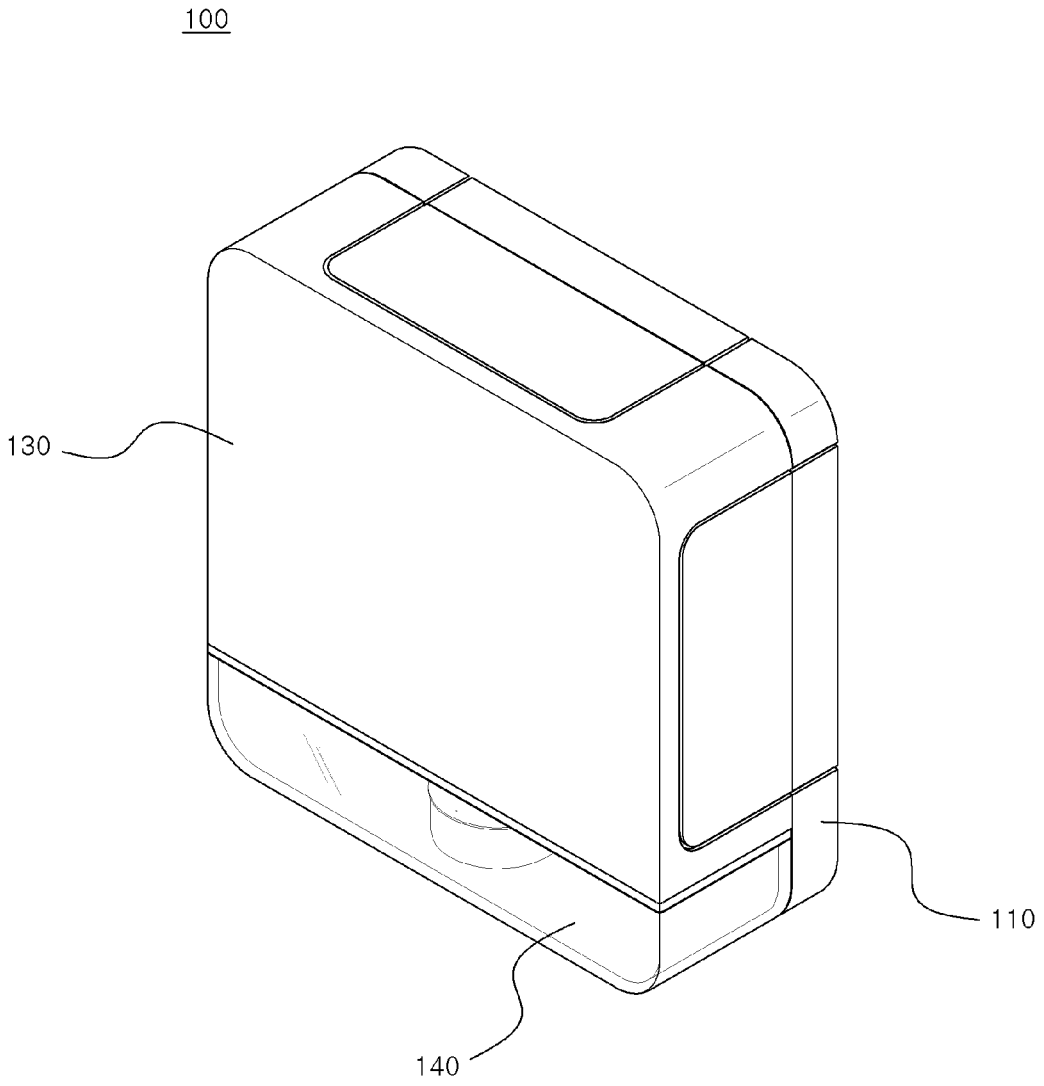
FIG. 1 is a perspective view of a duct for an air conditioner according to an exemplary embodiment of the present invention.

Hereinafter, exemplary embodiments of the present invention will be described in detail with reference to the accompanying drawings, but the present invention is not limited or restricted to the exemplary embodiments. For reference, in the description, like reference numerals substantially refer to like elements, which may be described by citing contents disclosed in other drawings under such a rule and contents determined to be apparent to those skilled in the art or repeated may be omitted.

Figure 2:
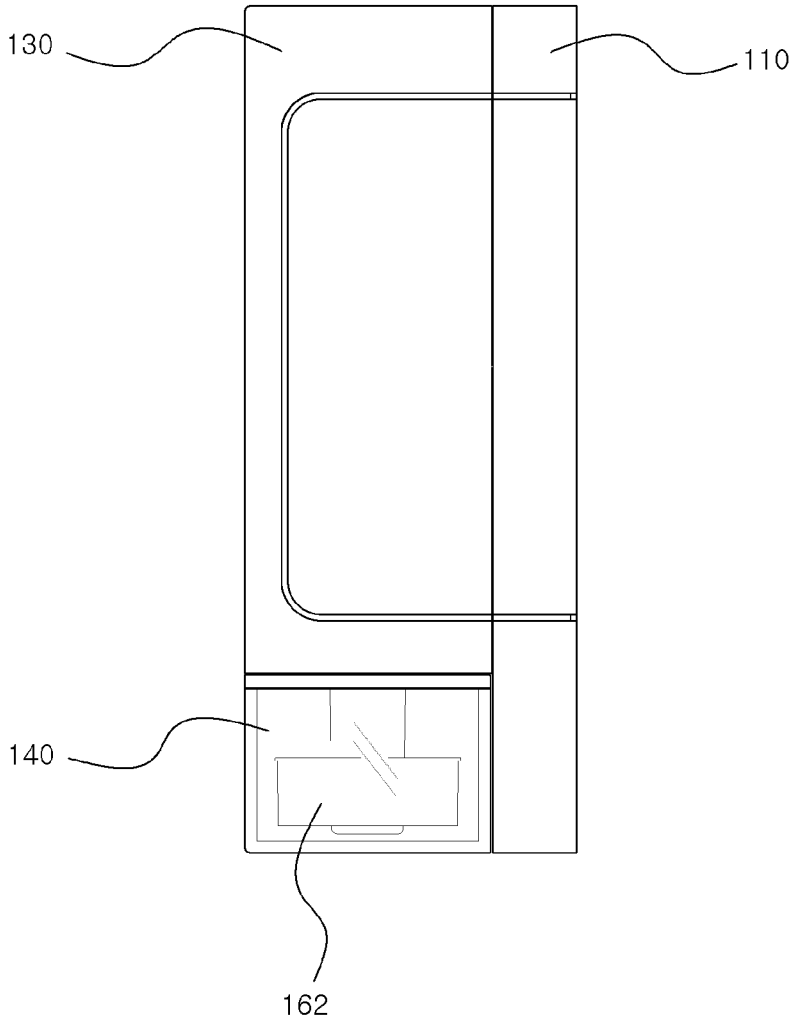
FIG. 2 is a side view of the duct for the air conditioner of FIG. 1.
Figure 3:
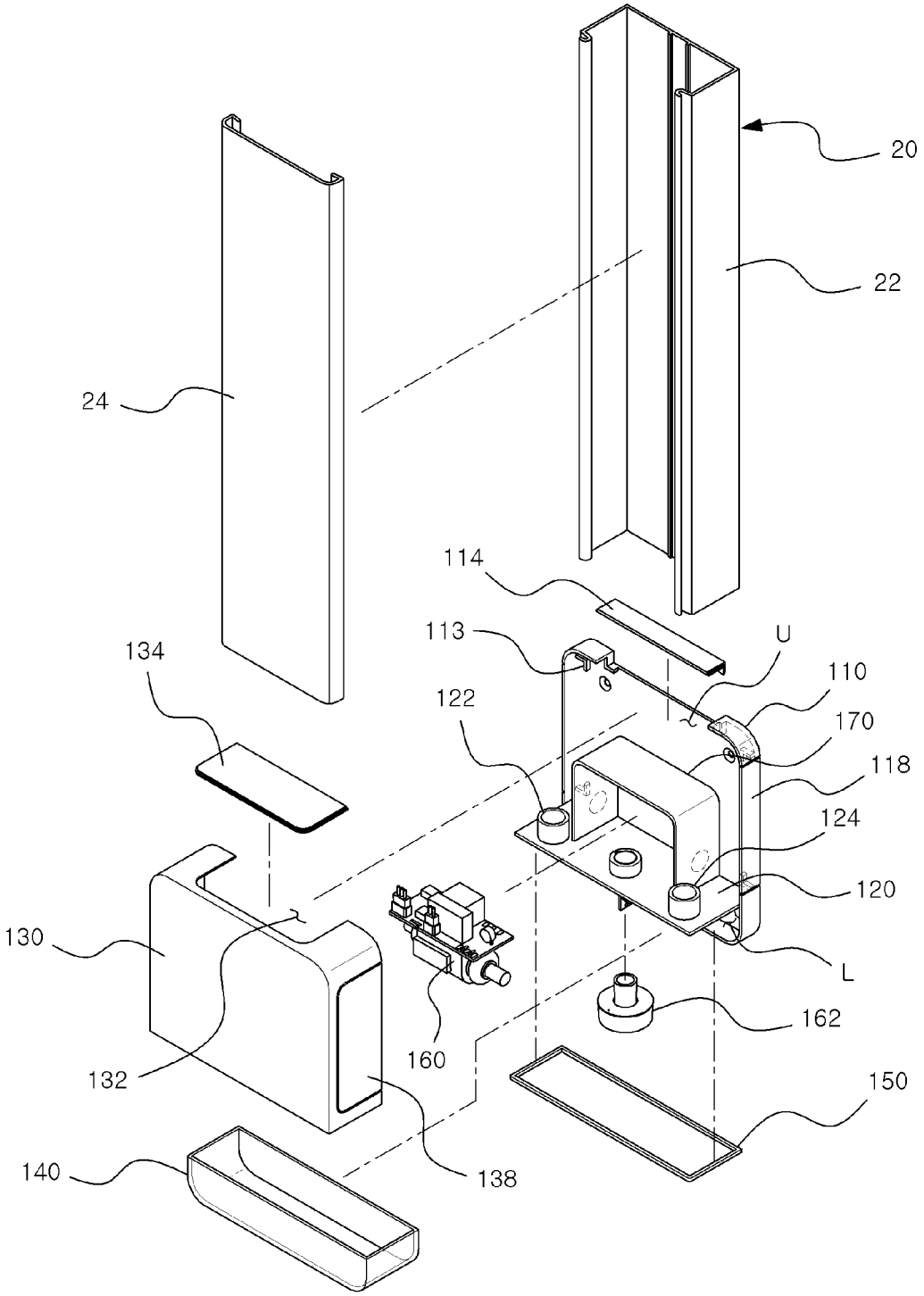
FIG. 3 is an exploded view of the duct for the air conditioner of FIG. 1.
Figure 4:
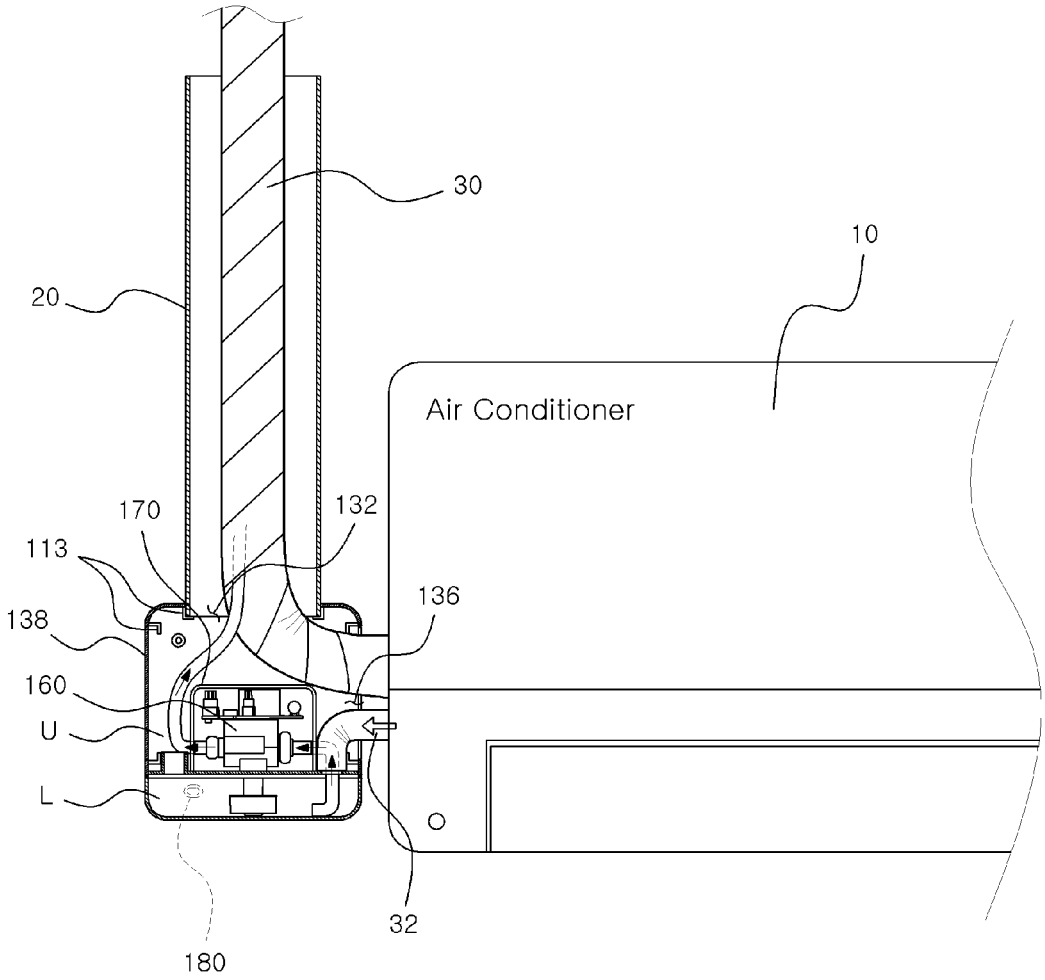
FIG. 4 is a cross-sectional view for describing a using state of the duct for the air conditioner of FIG. 1.

FIG. 1 is a perspective view of a duct for an air conditioner according to an exemplary embodiment of the present invention, FIG. 2 is a side view of the duct for the air conditioner of FIG. 1, FIG. 3 is an exploded view of the duct for the air conditioner of FIG. 1, and FIG. 4 is a cross-sectional view for describing a using state of the duct for the air conditioner of FIG. 1.

Referring to FIGS. 1 to 4, a duct 100 for an air conditioner according to the exemplary embodiment is characterized so that a reservoir 140 is separated from a pump to be exposed to the outside of the duct. To this end, the duct 100 includes a base housing 110, a horizontal partition wall 120 disposed at the front side of the base housing 110 to divide the inside of the duct into an upper space U and a lower space L, an upper housing 130 covering the upper space U, a reservoir 140 detachably mounted on a lower portion of the horizontal partition wall 120 in response to the lower space L and collecting condensed water generated from the air conditioner 10 through inlets 122 and 124 formed in the horizontal partition wall 120, and a pump module 160 installed in the upper space U to discharge the condensed water stored in the reservoir 140.

In the exemplary embodiment, the reservoir 140 is located below the upper housing 130 and the horizontal bulkhead 120 to be exposed to the outside, and since the reservoir 140 is exposed to the outside of the duct 100, a user easily accesses the reservoir. That is, it is easy to determine the position of the reservoir 140 and very easy to determine a state of the reservoir 140 or an operation state of the pump module 160.

A general drain pump for an air conditioner is formed integrally with a reservoir and the drain pump and the reservoir are installed inside the duct, and thus it is difficult to determine a position and an operation state of the pump. Therefore, once the pump is installed in the duct, it is difficult to check the state of the reservoir, and as a result, even if a failure occurs, the failure cannot be immediately determined, and thus, it may be recognized whether the failure has occurred only after confirming that water overflowed due to the pump failure. In addition, because the reservoir itself forms a humid environment, even if the reservoir is left in an unsanitary state for a long time, there is no method to confirm the state of the reservoir.

However, according to the exemplary embodiment as the duct 100 in which the pump module 160 is embedded, it is possible to easily check a hygiene state of the reservoir 140 through the reservoir 140 exposed to the outside, to easily separate the reservoir 140 for checking or cleaning the inside of the reservoir 140, and to indirectly check an operation state of the pump module 160 by checking a water level and the like of the reservoir 140.

In addition, since both the pump module 160 and the reservoir 140 are provided in one duct 100, the installation of the duct and the pump may be completed in one installation.

In the general drain pump for the air conditioner, since the operation of the pump may be checked only by a sound, it is not possible to check whether the pump works properly, but in the duct 100 according to the exemplary embodiment, the reservoir 140 is exposed to the outside and the exposed reservoir 140 may be partially or entirely made of a transparent or translucent material so that the water level of the reservoir and the operation state of the pump may be visually confirmed.

In addition, in the duct 100, the reservoir 140 is made of a different material from other parts so as to express various designs as compared to conventional monotonous products and to be recognized as a single product rather than a simple duct.

To this end, the inside of the duct 100 may be divided into an upper space U and a lower space L, and a boundary between the upper space U and the lower space L may be defined by the horizontal partition wall 120. The upper space U on the horizontal partition wall 120 may be defined by the base housing 110 and the upper housing 130, and the pump module 160 may be mounted therein.

In addition, the lower space L under the horizontal partition wall 120 is not provided with a cover of the duct, but may form a space that may accommodate the condensed water by the reservoir 140 substantially. The reservoir 140 may be detachably mounted in the lower space L.

Therefore, the user may easily separate the reservoir 140 from the duct 100, and when the reservoir 140 is made of the transparent or translucent material, it is possible to easily check a change in the water level in the reservoir 140. In addition, it is possible to adjust a cleaning time and the like by visually confirming the internal state of the reservoir 140.

In the exemplary embodiment, while the reservoir 140 forms an outer surface connected to the upper housing 130, the duct 100 is formed in a low set-top box shape with rounded corners as a whole, but the capacity of the reservoir 140 may be increased or the shape of the reservoir 140 may be changed while maintaining a coupling method between the reservoir 140 and the upper housing 130 or the base housing 110.

As illustrated in FIG. 4, when the reservoir 140 is made of the transparent or translucent material, a light emitting device 180 is installed adjacent to the reservoir 140, and the light of the light emitting device 180 may be transmitted, refracted, diffused, or scattered by the reservoir or water in the reservoir.

In the exemplary embodiment, the light emitting device 180 may use an LED, and in the lower space L, the light emitting device 180 may be mounted on the front side of the base housing 110. The light of the light emitting device 180 may be visualized from the front side through the reservoir 140. In the present exemplary embodiment, one light emitting device 180 has been described, and an operation state of the pump module, presence or absence of a failure, a cleaning time of the reservoir, a water level state, and the like may be displayed.

In the exemplary embodiment, the base housing 110 is provided in a substantially plate shape and fixed to one wall surface of the air conditioner 10, and the upper housing 130 may accommodate the upper space U divided by the horizontal partition wall 120, and the pump module 160 and a protective partition wall 170 therein.

The protective partition wall 170 is formed at an upper center of the horizontal partition wall 120, and the pump module 160 is mounted therein. The pump module 160 may be used for discharging the condensed water in the reservoir 140 to the outside, and an inlet may be connected to the condensed water in the reservoir 140, and an outlet may be connected to a drain hose connected to the outside through a connection duct 20. As indicated by a black arrow, the condensed water is sucked through the inlet by the operation of the pump module 160 and discharged to the outside through the outlet.

The connection duct 20 may be formed to pass through a refrigerant pipe, a power cable, a drain hose, etc., which are connected from the outside, and the connection duct 20 may also be provided with a wall fixing part 22 fixed to the wall surface and a cover 24 covering the wall fixing part 22.

The duct 100 for the air conditioner of the exemplary embodiment is installed adjacent to the side surface of the air conditioner 10, the drain pipe 32 of the air conditioner 10 is introduced to the upper space U through a side opening 136 formed between the upper housing 130 and the base housing 110 and an end of the drain pipe 32 is connected to a second inlet 124 of the horizontal partition wall 120.

As indicated by a white arrow, the condensed water generated in the air conditioner 10 is introduced into the reservoir 140, and when the condensed water reaches a certain level, the pump module 160 operates to discharge the condensed water collected in the reservoir 140 to the outside.

The duct 100 of the exemplary embodiment may include an upper opening 132 and a side opening 136. As illustrated in the drawing, the positions of the upper opening 132 and the side opening 136 may be blocked by separator portions or sheets 134, 114, 138, and 118 before the installation, and the separator portions 134, 114, 138, and 118 may be defined by a cutting line and then if necessary, an installer may form the openings by separating the separator portions formed in the upper housing 130 or the base housing 110.

In the exemplary embodiment, the connection duct 20 is installed on the top and the air conditioner 10 is formed on the right side. Accordingly, the pipe 30 introduced through the connection duct 20 is introduced to the upper space U through the upper opening 132, passes through the upper space U, and then is connected with the air conditioner 10 through the side opening 136 on the right side. Also, in the air conditioner 10, the drain pipe 32 is introduced to the upper space U through the side opening 136, which is formed on the same level or higher than the horizontal partition wall, and connected to the second inlet 124.

While the installer installs the air conditioner 10 and the like, the duct 100 of the present invention is installed adjacent to the air conditioner 10 and the separator portions 134, 114, 138, and 118 formed in at least one of the upper housing 130 and the base housing 110 may be separated to form the upper opening 132 or the side opening 136 later.

Figure 5:
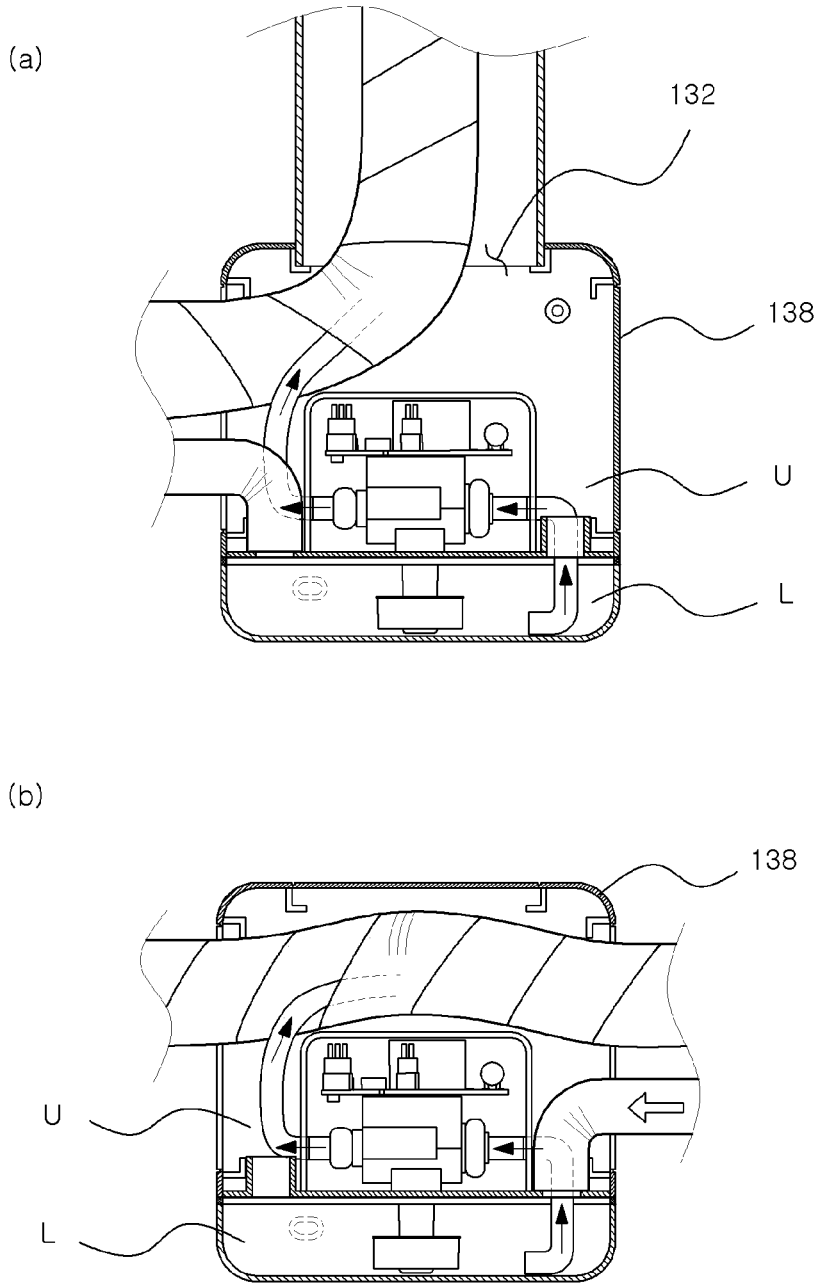
FIG. 5 is a cross-sectional view for describing use examples of the duct for the air conditioner according to the exemplary embodiment of the present invention.
Figure 6:
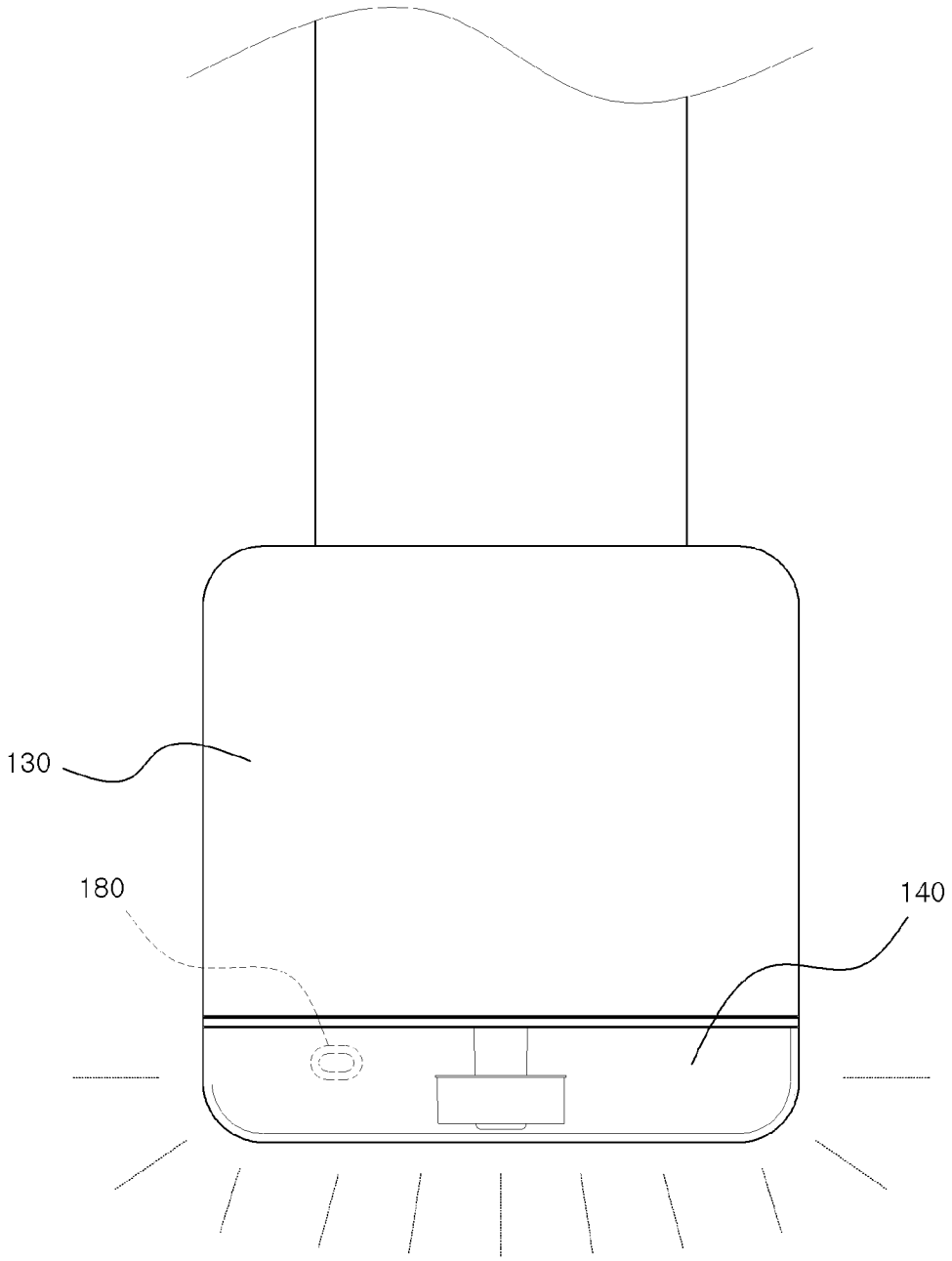
FIG. 6 is a front view for describing a light emitting device of the duct for the air conditioner according to the exemplary embodiment of the present invention.

FIG. 5 is a cross-sectional view for describing use examples of the duct for the air conditioner according to the exemplary embodiment of the present invention and FIG. 6 is a front view for describing a light emitting device of the duct for the air conditioner according to the exemplary embodiment of the present invention.

Referring to (a) of FIG. 5, the separator portions may correspond to the side openings and may be formed in both the upper housing and the base housing. The installer may remove the separator portion or partially remove sidewalls in a desired direction to form side opening in consideration of the positions of the air conditioner and the duct regardless of the left and right sides.

Unlike the L-shaped duct mentioned in the related art, in the duct of the exemplary embodiment, the base housing 110 and the upper housing 130 are provided symmetrically, and the pump module 160 is installed in the protective partition wall 170 formed in the center thereof, so that the duct of the exemplary embodiment may be used together in both the left and right directions.

As illustrated in (a) of FIG. 5, a pipe and the like may be introduced from the upper opening 132, and pass through the upper space U and the left side opening 136 on the drawing, and to this end, there is no need to change the installation direction of the duct.

Referring to (b) of FIG. 5, an air conditioner is disposed on the right side of the duct, and a connection duct for a pipe or the like may be introduced through the side opening. In this case, the upper opening 132 may not be used, and the pipe and the like are introduced from the side opening 136 on the left side only by using the side openings 136 formed on both sides and pass through the upper space U to be connected to the side opening 136 on the right side, and thus, there is no need to change the installation direction of the duct.

Unlike the L-shaped duct mentioned in the related art, in the duct of the exemplary embodiment, the base housing 110 and the upper housing 130 are provided symmetrically, and the pump module 160 is installed in the protective partition wall 170 formed in the center thereof, so that the duct of the exemplary embodiment may be used together in both the left and right directions.

In addition, in order to enable this, a first inlet 122 and the second inlet 124 may be disposed to be biased to the left and right sides respectively as inlets on both sides of the horizontal partition wall 120, and the drain pipe 32 of the air conditioner 10 may be connected to the first inlet 122 or the second inlet 124 so that smooth fluid communication may occur regardless of the direction.

Referring to FIGS. 4 and 5, a locking step 113 for supporting an end of the connection duct adjacent to the inlet of the upper opening 132 and the side opening 136 may be formed in the base housing 110. The locking step 113 may be formed in an L-shaped shape to face each other to prevent the end of the connection duct 20 from being introduced at a predetermined depth or more.

Referring to FIG. 6, the light emitting device 180 is provided using an LED, and is mounted on the front side of the base housing 110 in the lower space L. Accordingly, the light of the light emitting device 180 may be visualized from the front side through the reservoir 140. One light emitting device 180 has been described, and an operation state of the pump module, presence or absence of a failure, a cleaning time of the reservoir, a water level state, and the like may be displayed by controlling a color, brightness, a switching cycle or a pattern of the light emitting device.

Figure 7:
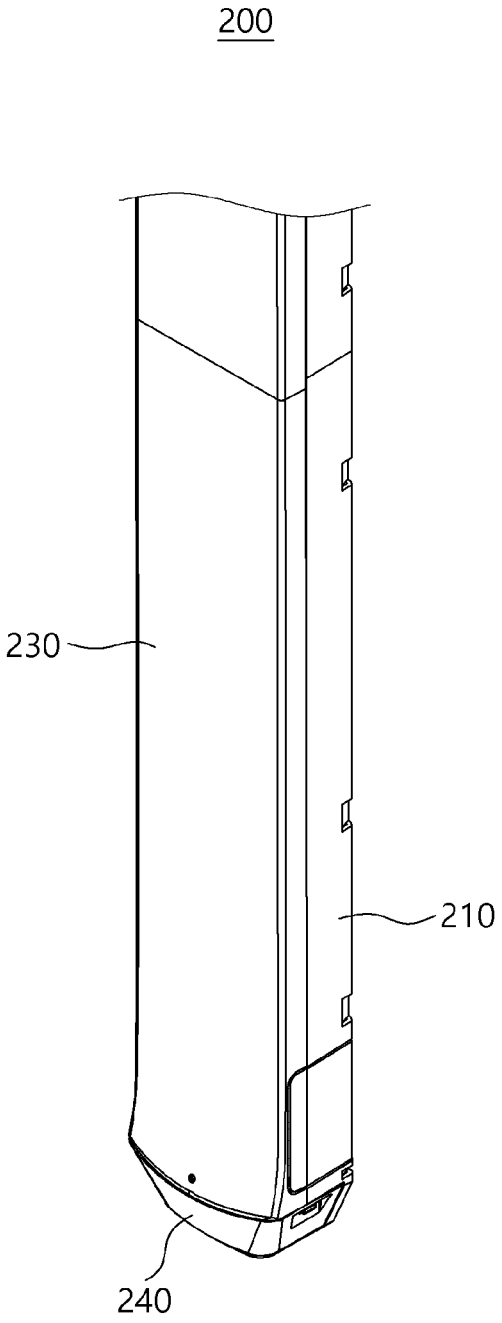
FIG. 7 is a perspective view of a duct for an air conditioner according to an exemplary embodiment of the present invention.
Figure 8:
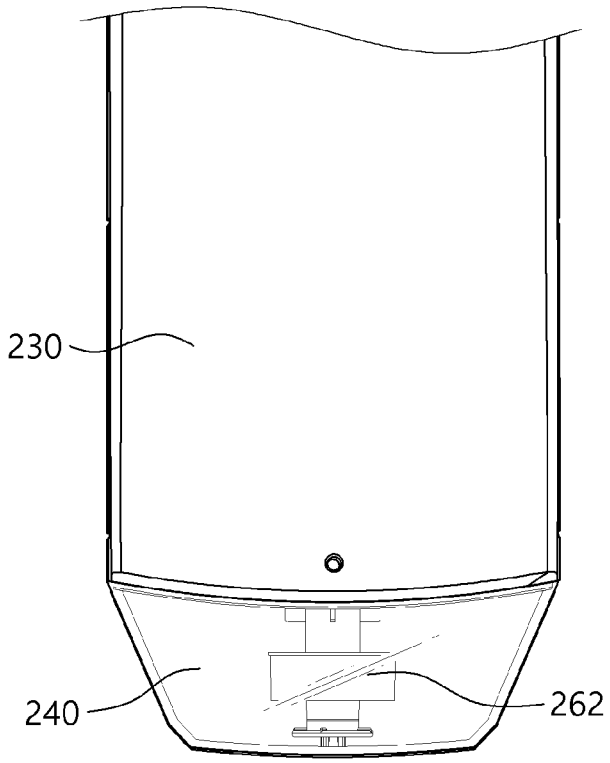
FIG. 8 is a front view of the duct for the air conditioner of FIG. 7.
Figure 9:
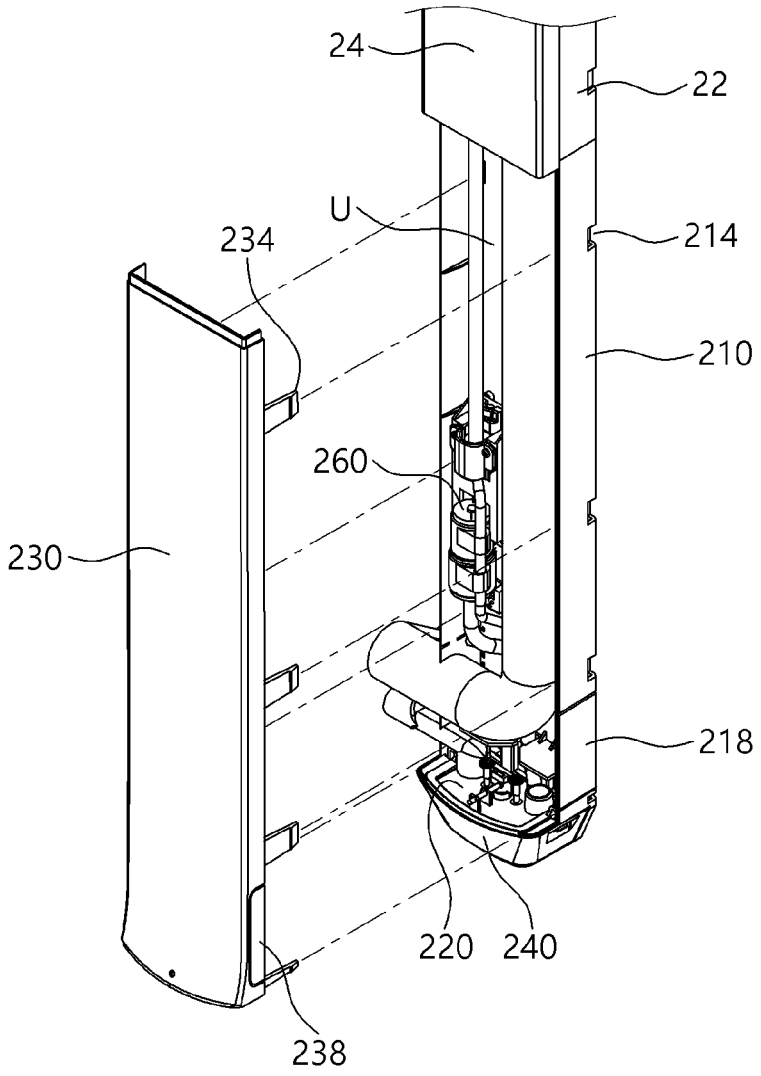
FIG. 9 is an exploded view of an upper housing separated from the duct for the air conditioner of FIG. 7.
Figure 10:
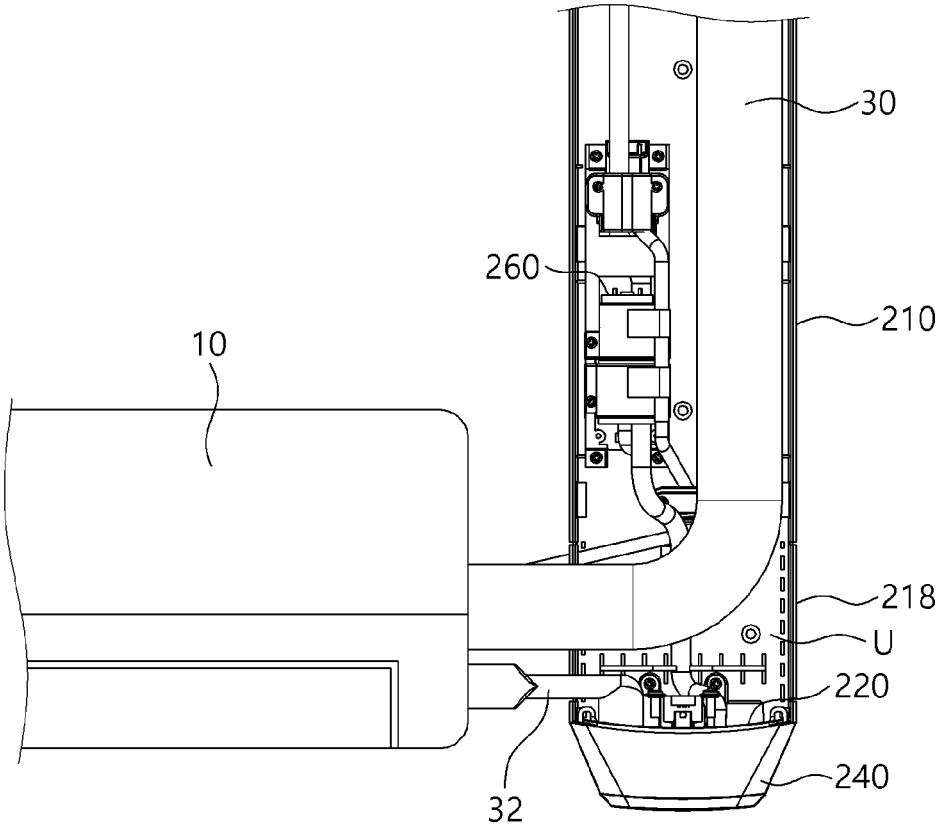
FIG. 10 is a front view for describing a state in which the upper housing is removed from the duct for the air conditioner of FIG. 7.
Figure 11:
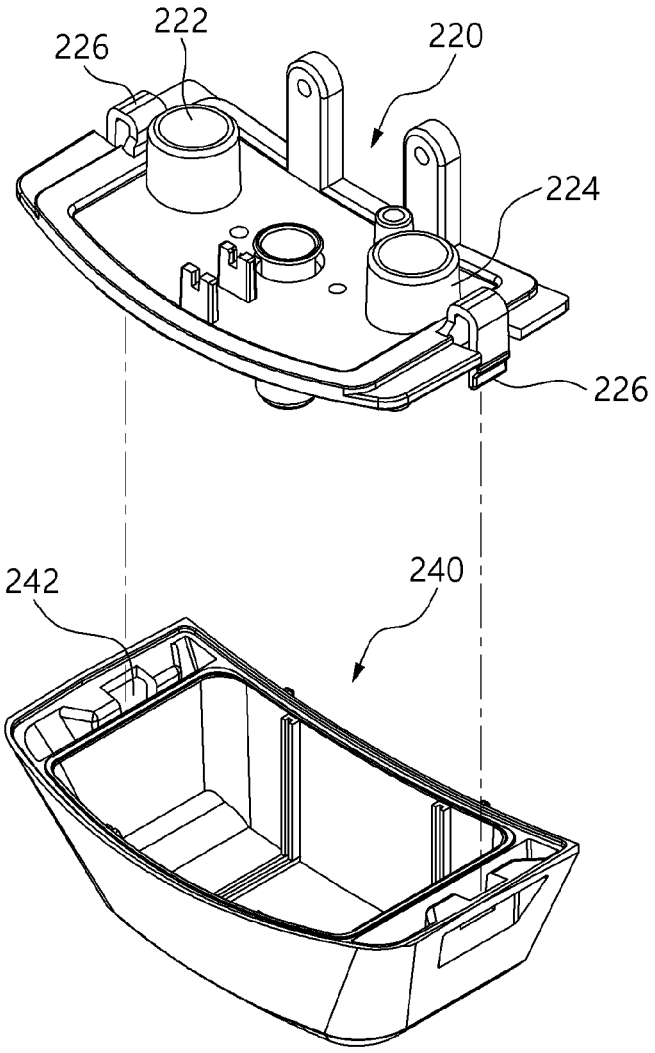
FIG. 11 is an exploded perspective view for describing a coupling relationship between a horizontal partition wall and a reservoir in the duct for the air conditioner according to the exemplary embodiment of the present invention.
Figure 12:
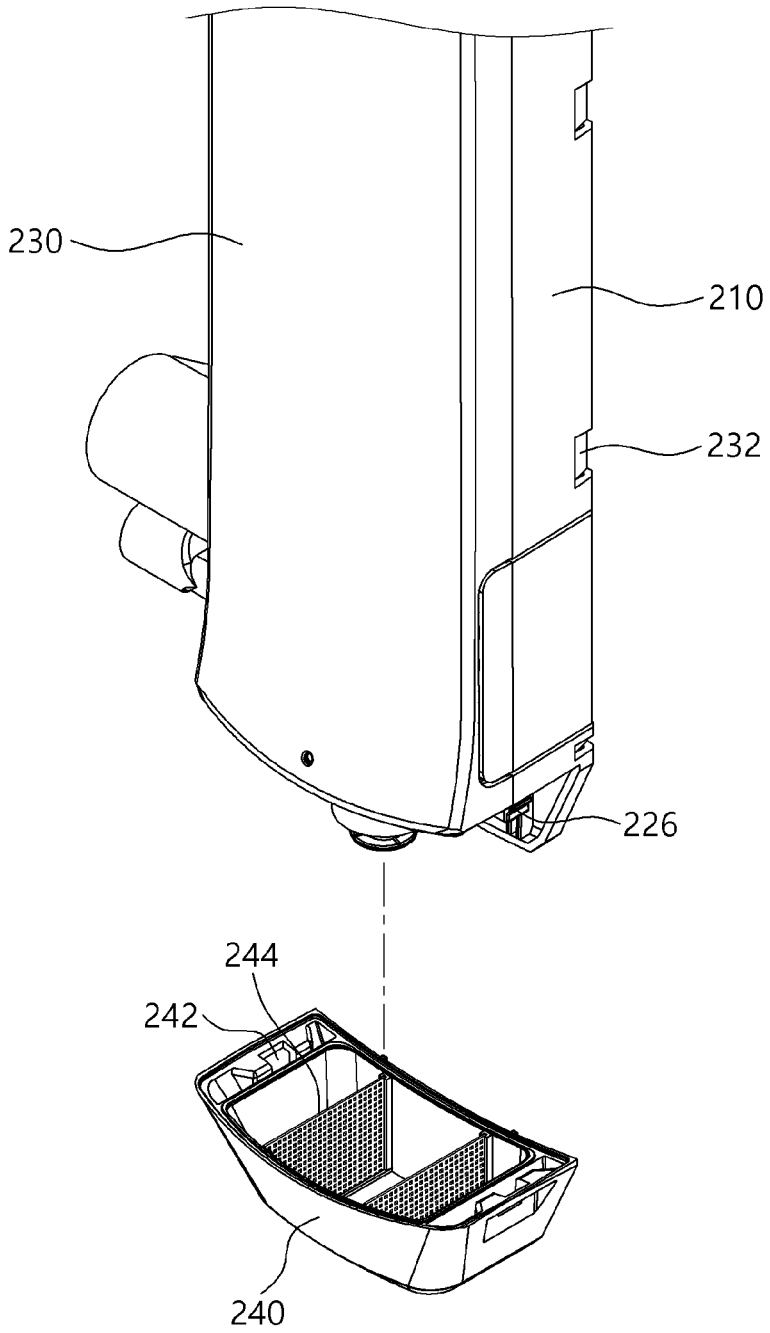
FIG. 12 is an exploded perspective view for describing a process of coupling and separating the reservoir in the duct for the air conditioner according to the exemplary embodiment of the present invention.
Figure 13:
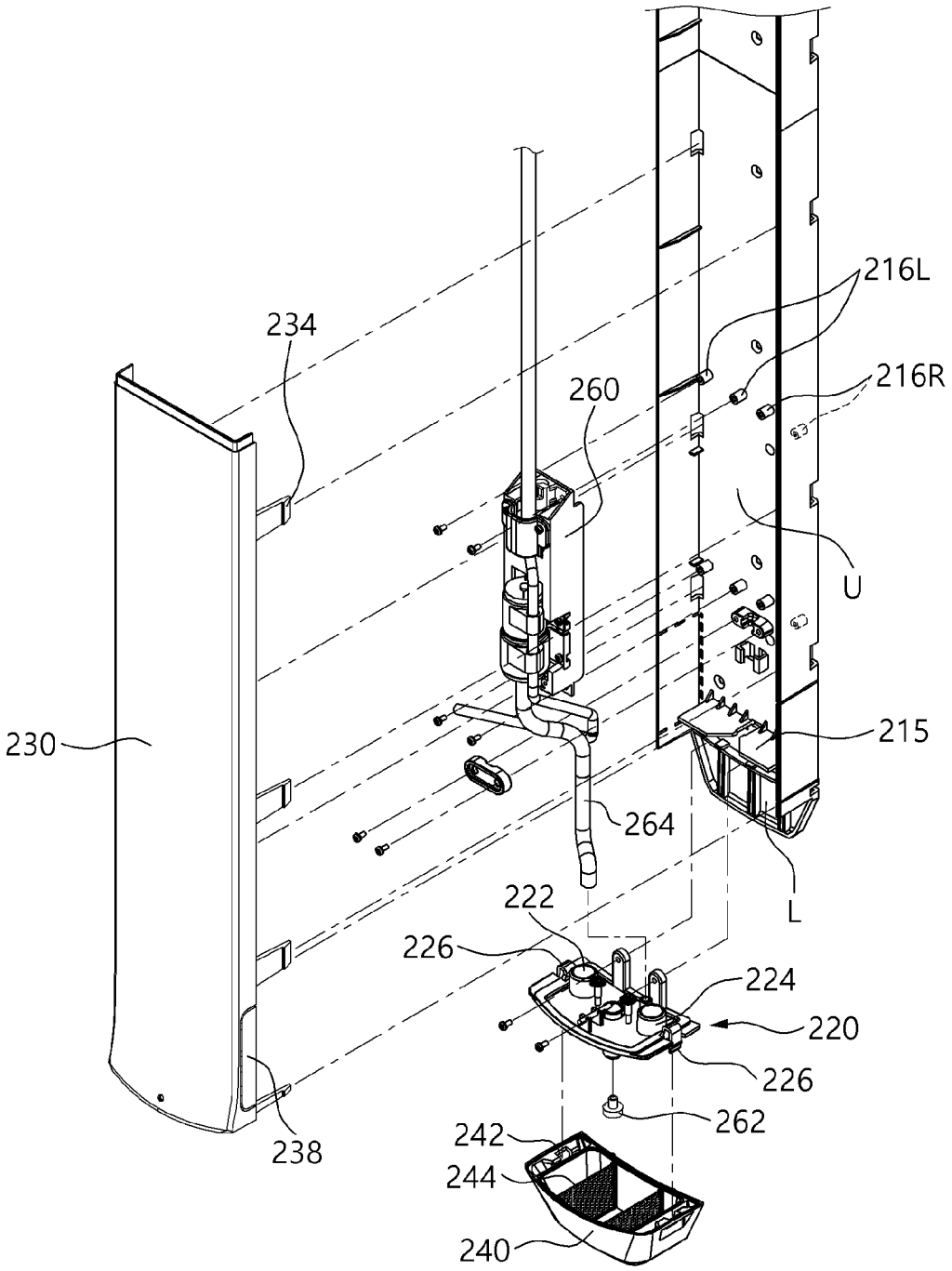
FIG. 13 is an exploded perspective view for describing an inner portion of the duct for the air conditioner according to the exemplary embodiment of the present invention.

FIG. 7 is a perspective view of a duct for an air conditioner according to an exemplary embodiment of the present invention, FIG. 8 is a front view of the duct for the air conditioner of FIG. 7, FIG. 9 is an exploded view of an upper housing separated from the duct for the air conditioner of FIG. 7, and FIG. 10 is a front view for describing a state in which the upper housing is removed from the duct for the air conditioner of FIG. 7. FIG. 11 is an exploded perspective view for describing a coupling relationship between a horizontal partition wall and a reservoir in the duct for the air conditioner according to the exemplary embodiment of the present invention, FIG. 12 is an exploded perspective view for describing a process of coupling and separating the reservoir in the duct for the air conditioner according to the exemplary embodiment of the present invention, and FIG. 13 is an exploded perspective view for describing an inner portion of the duct for the air conditioner according to the exemplary embodiment of the present invention.

Referring to FIGS. 7 to 13, a duct 200 for an air conditioner according to the exemplary embodiment includes a base housing 210, a horizontal partition wall 220 dividing the inside of the duct into an upper space U and a lower space L, an upper housing 230 covering the upper space U, a reservoir 240 mounted on the lower space L, and a pump module 260 separated from the horizontal partition wall 220 to be connected with the reservoir 240 through an intermediate inlet 264.

The base housing 210 and the upper housing 230 are vertically elongated to be formed in a straight line, and the upper portions of the base housing 210 and the upper housing 230 may be formed to have the same width as the ducts to be substantially connected thereto. Thus, an upper opening may be directly connected to an outer duct.

The base housing 210 is provided in a flat structure with an opened front surface, and the upper housing 230 also has a structure fixed to the front side of the base housing 210 in correspondence with the upper space U. In the exemplary embodiment, an elastic hook 234 extending toward the base housing 210 from the side surface of the upper housing 230 is included, and the elastic hook 234 may be fastened to a coupling hole 214 formed inside the base housing 210.

The upper space U may be approximately divided into left and right sides in correspondence with the base housing 210 and the upper housing 230 elongated vertically. For example, as illustrated in the drawing, the pump module 260 is spaced apart from the horizontal partition wall 220 by a predetermined height and positioned on the left side of the upper space U, and the pipe 30 and the like including a refrigerant pipe, an outlet, and the like pass toward the right side of the upper space U corresponding to the air conditioner 10.

As a result, the upper space U, the upper housing 230, and the base housing 210 according to the exemplary embodiment substantially maintain the same width as the duct 20 and the like, and the pump module 260, the pipe 30, and the like to be required may be all disposed.

The reservoir 240 is detachably mounted on the lower portion of the horizontal partition wall 220 in correspondence with the lower space L and may collect the condensed water generated from the air conditioner 10 through inlets 22 and 224 formed in the horizontal partition wall 220.

The ducts according to the exemplary embodiment are formed in a vertically straight line and have a symmetrical structure, so that there is no need to be installed differently depending on a direction. In addition, in case that the duct is installed on a right wall surface of the air conditioner 10, the pipe 30 or the like is introduced from the side opening on the left side of the duct, and the drain pipe 32 from the air conditioner 10 is connected to the inlet 222 adjacent to the horizontal partition wall 220.

As described below, the horizontal partition wall 220 and the reservoir 240 are detachably or separatably mounted to each other, and even if the upper housing 230 is not separated from the base housing 210, the reservoir 240 can be separated from the duct to clean or replace the reservoir.

In addition, since the reservoir 240 is located under the upper housing 230 and the horizontal partition wall 220 to be almost exposed to the outside, the user may easily determine the position of the reservoir 240 and the bucket and very easily determine the sanitary state of the reservoir 240 or the operation state of the pump module 260.

In addition, since the reservoir 240 is able to be separated immediately without the separation of the duct, it is easy to frequently clean the reservoir 240, and it is possible to prevent the water from overflowing while the water is not recognized due to a failure of the pump module 260.

A general drain pump for an air conditioner may recognize whether a failure has occurred only after confirming that the water actually overflows due to a pump failure, and since it is difficult for the general user to separate the duct itself, the user cannot expect to cope with the difficulty effectively.

In the general drain pump for the air conditioner, since the operation of the pump may be checked only by a sound, it is not possible to check whether the pump works properly, but in the duct 200 according to the present embodiment, the reservoir 240 is exposed to the outside and the exposed reservoir 240 may be partially or entirely made of a transparent or translucent material so that the level of the reservoir and the operation state of the pump may be visually confirmed.

In addition, in the duct 200, the reservoir 240 is made of a different material from other parts so as to express various designs as compared to conventional monotonous products and to be recognized as a single product rather than a simple duct.

The reservoir 240 may include hook coupling holes 242 formed at both sides of the reservoir 240, and reversely U-shaped elastic hooks 226 may be formed on both sides of the horizontal partition wall 220 in correspondence with the hook coupling holes 242. Accordingly, the reservoir 240 may be coupled at the lower portion of the horizontal partition wall 220 even without separating the upper housing 230 of the duct, and the elastic hook 226 may be mounted in a simple operation of pushing up until being fastened through the hook coupling holes 242 of the reservoir 240.

As such, the reservoir 240 may be separated from the duct 200 while the reservoir 240 moves down while pressing the elastic hook 226, and when the reservoir 240 is made of a transparent or translucent material, it is possible to easily check a change in the water level in the reservoir 240. In addition, it is possible to adjust a cleaning time and the like by visually checking the internal state of the reservoir 240.

In the exemplary embodiment, the light emitting device may be mounted in the upper space U, and may be visualized to the outside through a light-transmitting hole formed at a central lower portion of the upper housing 230 by using a light guide part disposed on the upper portion of the horizontal partition wall 220.

The pump module 260 may be used for discharging the condensed water in the reservoir 240 to the outside, and the intermediate inlet 264 may be connected to the condensed water in the reservoir 240, and an outlet may be connected to a drain hose connected to the outside through the connection duct 20 while being bound to the pipe 30 and the like. By the operation of a solenoid type pump module 260, the condensed water may be sucked through the intermediate inlet 264 and discharged to the outside through the outlet.

In the exemplary embodiment, the pump module 260 may be mounted by selecting one of the left and right positions, and the base housing 210 may be provided with position fixing parts 216L and 216R in correspondence to the installation position of the pump module 260 corresponding to the left and right arrangement of the pump module 260. In the duct of the exemplary embodiment, when the duct 200 is installed on the right side of the air conditioner 10, the pipe and the drain pipe 30 may occupy and pass through the right side of the upper space U inside the duct.

In this case, the drain pipe 32 from the air conditioner 10 is introduced through a side opening opened to the left to be connected to the left inlet 222 of the horizontal partition wall 220, and the pipe 30 and the like are introduced through the same side opening to pass through the right side in the upper space U, and the drain pipe 32 and the pipe 30 and the like may be divided by a hose fixing plate 215 protruding horizontally without interfering with each other.

The hose fixing plate 215 may further include a slit corresponding to the intermediate inlet 264 in the center, in addition to a function of separating the drain pipe 32 and the pipe 30 and the like. Accordingly, the intermediate inlet 264 is partially fixed to the horizontal partition wall 220 and the other end is connected to the pump module 260 to easily fix the reservoir 240 and the pump module 260 later. The slit of the hose fixing plate 215 may fix the intermediate inlet 264 to prevent the pipes from interfering with each other in the process of connecting the drain pipe 32 or the pipe 30 and the like later.

The connection duct 20 may be formed to pass through a refrigerant pipe, a power cable, a drain hose, etc., which are connected from the outside, and the connection duct 20 may also be provided with a wall fixing part 22 fixed to the wall surface and a cover 24 covering the wall fixing part 22.

Therefore, the duct 200 of the exemplary embodiment may include two side openings that may be selectively opened according to the installation position of the air conditioner 10, in addition to the upper opening that is integrally connected to the duct. As illustrated in the drawing, the position of the side opening is blocked by the separators 238 and 218, and the separators 238 and 218 are defined by a cutting line and then if necessary, an installer may form the openings by separating the separators formed in the upper housing 230 or the base housing 210.

In the exemplary embodiment, the connection duct 20 is installed on the top and the air conditioner 10 is formed on the right side. Accordingly, the pipe 30 and the like introduced through the connection duct 20 are introduced to the upper space U through the upper opening 232, and passes through the upper space U to be connected with the air conditioner 10 through the side opening 236 on the right side. Also, in the air conditioner 10, the drain pipe 32 is introduced to the upper space U through the side opening 236 and connected to the second inlet 224.

Although the upper opening 232 and the side opening 236 may be formed in an opened state in advance, the installer may install the duct 200 of the present invention to be adjacent to the air conditioner 10 in the process of installing the air conditioner 10 or the like. The installer may form side openings in a desired direction later by separating the separators 238 and 218 formed in at least one of the upper housing 230 and the base housing 210.

Accordingly, as illustrated in FIG. 13, the pipe and the like may be introduced from the upper opening and pass through the upper space U to be connected to the side opening on the left side, and to this end, there is no need to change the installation direction of the duct. Of course, when the side opening is opened incorrectly, other parts may be used and only the parts need to be replaced, and thus, it may be advantageous that there is no need to perform unnecessary perforation on the wall surface in this process.

As described above, the present invention has been described with reference to the preferred embodiments. However, it will be appreciated by those skilled in the art that various modifications and changes of the present invention can be made without departing from the spirit and the scope of the present invention which are defined in the appended claims and their equivalents.

The invention claimed is:

1. A duct which is installed adjacent to a wall-type air conditioner, the duct comprising:

a base housing installed on a wall surface adjacent to the air conditioner;

a horizontal partition wall disposed at a front side of the base housing to divide an inside of the duct into an upper space and a lower space, a first inlet and a second inlet being formed in the horizontal partition wall;

an upper housing mounted to the base housing on an upper portion of the horizontal partition wall and covering the upper space, the upper housing having a side opening formed in a side surface thereof through which a drain pipe of the air conditioner is inserted into the upper space;

a translucent reservoir detachably mounted on a lower portion of the horizontal partition wall and configured to collect condensed water generated from the air conditioner through the drain pipe connected to the first inlet, the translucent reservoir being accommodated in the lower space under the upper housing to be exposed to outside of the duct and being so configured as to be separated from the horizontal partition wall without disassembling the upper housing from the base housing while maintaining the base housing fixed on the wall surface; and a pump module installed in the upper space to discharge the condensed water through the second inlet, the condensed water being collected in the translucent reservoir through the first inlet.

2. The duct of claim 1, wherein a light emitting device is mounted adjacent to the reservoir to display an operation state of the pump module.

3. The duct of claim 1, wherein a light emitting device is mounted in the lower space to monitor the reservoir from outside of the duct.

4. The duct of claim 1, further comprising: a protective partition wall covering the pump module.

* * * * *